US005907904A

United States Patent [19]

Gerber et al.

[11] Patent Number: 5,907,904

[45] Date of Patent: Jun. 1, 1999

[54] METHOD OF MANUFACTURING AN EXHAUST MUFFLER WITH STAMP FORMED INTERNAL COMPONENTS

[75] Inventors: James E. Gerber, Clayton, N.C.; Jon W. Harwood; Bruno A. Rosa, both of Toledo, Ohio

[73] Assignee: AP Parts Manufacturing Company, Toledo, Ohio

[21] Appl. No.: 08/901,276

[22] Filed: Jul. 28, 1997

Related U.S. Application Data

[62] Division of application No. 08/620,594, Mar. 22, 1996, Pat. No. 5,717,173.

[51] Int. Cl.[6] ..... B23P 15/00

[52] U.S. Cl. ..... 29/890.08; 29/890.03; 29/469

[58] Field of Search ..... 29/890.08, 890.03, 29/428, 469; 181/243

[56] References Cited

U.S. PATENT DOCUMENTS

| | | | |
|---|---|---|---|
| D. 363,908 | 11/1995 | Maag . | |
| 705,357 | 7/1902 | Keating | 181/264 |
| 1,110,040 | 9/1914 | Chatain | 181/238 |
| 2,484,826 | 10/1949 | Harley | 181/49 |
| 2,484,827 | 10/1949 | Harley | 181/35 |
| 2,658,580 | 11/1953 | Trembley | 181/49 |
| 2,860,722 | 11/1958 | Gerstung | 181/68 |
| 2,902,109 | 9/1959 | Burgess et al. | 181/53 |
| 2,943,695 | 7/1960 | Jeffords | 181/50 |
| 3,125,182 | 3/1964 | Earley | 181/53 |
| 3,140,755 | 7/1964 | Tranel | 181/61 |
| 3,158,222 | 11/1964 | Richmond | 181/59 |
| 3,176,791 | 4/1965 | Betts et al. | 181/52 |
| 3,198,284 | 8/1965 | Powers | 181/54 |
| 3,220,508 | 11/1965 | Nordquest et al. | 181/61 |
| 3,638,756 | 2/1972 | Thiele | 181/282 |
| 3,650,354 | 3/1972 | Gordon | 181/61 |
| 3,709,320 | 1/1973 | Hölleri et al. | 181/61 |
| 3,724,591 | 4/1973 | Malkiewicz | 29/890.08 |
| 3,827,529 | 8/1974 | Frietzsche et al. | 181/238 |
| 3,852,041 | 12/1974 | Moore et al. | 181/288 F |
| 4,064,962 | 12/1977 | Hunt | 181/272 |
| 4,108,274 | 8/1978 | Snyder | 181/229 |
| 4,109,751 | 8/1978 | Kabele | 181/247 |
| 4,132,286 | 1/1979 | Hasui et al. | 181/265 |
| 4,165,798 | 8/1979 | Martinez | 181/265 |
| 4,396,090 | 8/1983 | Wolfhugel | 181/282 |
| 4,415,059 | 11/1983 | Hayashi | 181/250 |
| 4,418,790 | 12/1983 | Agnew | 181/268 |
| 4,422,519 | 12/1983 | Nomura et al. | 181/219 |
| 4,456,091 | 6/1984 | Blanchot | 181/282 |
| 4,523,660 | 6/1985 | Gaddi | 181/228 |
| 4,598,790 | 7/1986 | Uesugi et al. | 181/252 |
| 4,690,245 | 9/1987 | Gregorich et al. | 181/272 |

(List continued on next page.)

FOREIGN PATENT DOCUMENTS

| | | |
|---|---|---|
| 59-155528 | 4/1984 | Japan . |
| 59-43456 | 12/1984 | Japan . |
| 61-14565 | 7/1986 | Japan . |
| 632013 | 1/1950 | United Kingdom . |
| 1012463 | 12/1965 | United Kingdom . |
| 2120318 | 11/1983 | United Kingdom . |

*Primary Examiner*—Irene Cuda
*Attorney, Agent, or Firm*—Dickinson Wright PLLC

[57] ABSTRACT

A muffler includes a pair of internal plates that are formed to define an array of channels and at least one chamber. The internal plates are connected in face-to-face relationship such that the channels define tubes that communicate with the chamber. At least one short section of conventional tube may be disposed between the plates to achieve a selected exhaust gas flow pattern. The connected internal plates is slid longitudinally into a tubular outer shell and end caps are secured to opposed ends to substantially enclose the muffler. The internal plates can be remanufactured prior to insertion into the tubular outer shell, and can be slid into tubular external shells of different lengths for significantly altering the acoustical tuning of the muffler.

5 Claims, 5 Drawing Sheets

U.S. PATENT DOCUMENTS

| | | | |
|---|---|---|---|
| 4,700,806 | 10/1987 | Harwood | 181/282 |
| 4,736,817 | 4/1988 | Harwood | 181/282 |
| 4,759,423 | 7/1988 | Harwood et al. | 181/282 |
| 4,760,894 | 8/1988 | Harwood et al. | 181/282 |
| 4,765,437 | 8/1988 | Harwood et al. | 181/282 |
| 4,809,812 | 3/1989 | Flugger | 181/268 |
| 4,821,840 | 4/1989 | Harwood et al. | 181/282 |
| 4,836,330 | 6/1989 | Harwood et al. | 181/282 |
| 4,847,965 | 7/1989 | Harwood et al. | 29/157 R |
| 4,860,853 | 8/1989 | Moring, III | 181/282 |
| 4,894,987 | 1/1990 | Harwood et al. | 181/282 |
| 4,901,815 | 2/1990 | Harwood et al. | 181/282 |
| 4,901,816 | 2/1990 | Garey | 181/296 |
| 4,905,791 | 3/1990 | Garey | 181/282 |
| 4,909,348 | 3/1990 | Harwood et al. | 181/282 |
| 4,928,372 | 5/1990 | Harwood et al. . | |
| 4,941,545 | 7/1990 | Wilcox et al. . | |
| 5,004,069 | 4/1991 | Van Blaircum et al. . | |
| 5,012,891 | 5/1991 | Macaluso | 181/282 |
| 5,042,125 | 8/1991 | Harwood et al. . | |
| 5,164,551 | 11/1992 | Harwood et al. . | |
| 5,173,577 | 12/1992 | Clegg et al. . | |
| 5,252,788 | 10/1993 | Emrick et al. . | |
| 5,327,722 | 7/1994 | Clegg et al. . | |
| 5,428,194 | 6/1995 | Emrick et al. . | |
| 5,448,831 | 9/1995 | Harwood . | |
| 5,473,891 | 12/1995 | Baxter et al. . | |
| 5,563,383 | 10/1996 | Harwood . | |
| 5,563,385 | 10/1996 | Harwood . | |
| 5,579,577 | 12/1996 | Preslicka et al. | 29/890.03 |
| 5,597,986 | 1/1997 | Harwood et al. . | |

METHOD OF MANUFACTURING AN EXHAUST MUFFLER WITH STAMP FORMED INTERNAL COMPONENTS

This application is a division of application Ser. No. 08/620,594, filed Mar. 22, 1996, which application is now U.S. Pat. No. 5,717,173.

BACKGROUND OF THE INVENTION

1. Field of the Invention

The subject invention relates to vehicular exhaust mufflers with stamp formed internal components, a tubular outer shell surrounding the stamped internal components and end caps connected to opposed ends of the tubular outer shell.

2. Description of the Prior Art

A typical prior art exhaust muffler is shown in FIG. 1, and is identified generally by the numeral 10. The prior art muffler 10 is a generally elongated structure having opposed inlet and outlet ends 12 and 14. An inlet tube 16 extends from the inlet end 12 to a location inside the prior art muffler 10. The inlet tube 16 is supported by baffles 18 and 20 which are of substantially identical oval or circular configuration. Portions of the inlet tube 16 between the baffles 18 and 20 have perforations 22 to permit a controlled expansion of exhaust gas. A return tube 24 also extends between the baffles 18 and 20 and is provided with perforations 26 to permit an expansion and cross-flow of exhaust gas. An outlet tube 28 is disposed between the inlet tube 16 and the return tube 24. The outlet tube 28 extends through and is supported by the baffles 18 and 20, and continues to the outlet end 14 of the prior art muffler 10. Portions of the outlet tube 28 between the baffles 18 and 20 are provided with perforations 30.

The prior art muffler 10 also has parallel baffles 32 and 34 between the baffle 20 and the outlet end 14 of the prior art muffler 10. Portions of the outlet tube 28 between the baffles 32 and 34 have perforations 36. A short non-perforated tuning tube 38 extends through the baffles 32 and 34.

The tubes 16, 24, 28 and 38 are welded to the respective baffles to define a substantially rigid subassembly that will not generate noise in the presence of vibrations and flowing exhaust gas. The subassembly of the tubes 16, 24, 28 and 38 and the baffles 18, 20, 32 and 34 is slid into a tubular outer shell 40 that has a cross-sectional shape identical to the shape of the baffles. The tubular outer shell 40 is then welded to the baffles 18, 20, 32 and 34. End caps or heads 42 and 44 are secured to the outer shell 40 at the opposed inlet and outlet ends 12 and 14 of the prior art muffler 10.

Exhaust gas enters the inlet tube 16 of the prior art muffler 10 and is permitted to expand through the perforations 22 and into an expansion chamber 46 defined between the baffles 18 and 20. Most of the exhaust gas will continue to flow through the inlet tube 16 and into a first reversing chamber 48 defined between the baffles 20 and 32. This exhaust gas will flow around both sides of the outlet tube 28 and into the return tube 24. Exhaust gas flowing through the return tube 24 may expand into the expansion chamber 46. The exhaust gas will continue to flow through the return tube 24 and into a second reversing chamber 50 defined between the baffle 18 and the end cap or head 42. Exhaust gas will then continue into the outlet tube 28. Some expansion occurs through the perforations 30 in the expansion chamber 46. The exhaust gas will then continue to flow through the outlet tube 28. Expansion through perforations 36 will be permitted into a high frequency tuning chamber 52 defined between the baffles 32 and 34.

A low frequency resonating chamber 54 is defined between the baffle 34 and the end cap 44. Communication with the low frequency resonating chamber 54 is provided by the tuning tube 38.

Prior art mufflers, such as those shown in FIG. 1, generally perform well. In particular, a major portion of the noise associated with the flowing exhaust gas will be attenuated by the expansion and cross flow of exhaust gas in the expansion chamber 46. Additional attenuation will be achieved as the exhaust gas flows around both sides of the outlet tube 28 in the first reversing chamber 48. The combination of perforations 36 and the high frequency tuning chamber 52 achieves an attenuation of high frequency noise that may not adequately be attenuated by the expansion chamber 46. The combination of the low frequency resonating chamber 54 and the tuning tube 38 attenuates low frequency noise that is not adequately attenuated by the expansion chamber 46.

The dimensions and placement of the various components in the prior art muffler 10 are selected in accordance with the acoustical tuning needs of the exhaust system, back pressure requirements and available space on the underside of a vehicle. The acoustical tuning performance of the prior art muffler 10 can be varied substantially by changing the volume of the respective chambers, changing the dimensions of the tubes, and/or increasing the area and/or shape of the perforations in the tubes.

Prior art exhaust mufflers, such as the prior art muffler 10 shown in FIG. 1, are effective in attenuating exhaust gas noise. However, these conventional prior art mufflers require a large number of separate components that must be assembled by manufacturing processees that are not well suited to automation. Hence these labor intensive manufacturing processees tend to be very expensive. Additionally, the prior art muffler 10 necessarily has a large number of abrupt edges and surfaces meeting at right angles. It has been found that such abrupt edges and well defined corners contribute to air turbulence that can increase back pressure and complicate acoustical tuning.

U.S. Pat. No. 4,486,932 and U.S. Pat. No. 4,516,659 are assigned to the assignee of the subject invention and relate to replacement mufflers and processees for making replacement mufflers. The mufflers disclosed in these patents have a plurality of separate tubes, transverse baffles and tubular outer shells as in the prior art muffler 10 illustrated in FIG. 1. The dimensions of the replacement muffler only approximate the dimensions of the original equipment muffler being replaced. Differences between dimensions of the replacement muffler and the original equipment muffler are compensated for by differences in the lengths of the inlet and outlet tubes extending from the muffler. Thus, families of replacement mufflers can be provided with identical muffler bodies but with differently dimensioned inlet and outlet tubes to compensate for differences between the dimensions of the original equipment muffler and the replacement muffler. A smaller and simpler inventory of replacement mufflers is provided with this teaching to simplify manufacturing processes and reduce manufacturing costs.

The assignee of the subject invention also has made several improvements in the field of mufflers with stamp formed components. The typical stamp formed muffler includes a pair of internal plates stamped with arrays of channels. The plates are secured in face-to-face relationship such that the channels define tubes to carry flowing exhaust gas between the plates. The typical stamp formed muffler further includes a pair of stamped formed external shells that are effectively sandwiched about the internal plates. An extremely effective and commercially successful muffler of this general type is shown in U.S. Pat. No. RE 33,370 and in reexamined U.S. Pat. No. 4,736,817.

U.S. Pat. No. 4,847,965 also is owned by the assignee of the subject invention and relates to a method of using combinations of stamping dies and die subsets to make a system of dimensionally similar mufflers. The die subsets can be replaced to change some of the internal components in ways that alter the acoustical performance of certain mufflers in the system. This stamp formed manufacturing process typically is employed for original equipment mufflers where different models of a new car will have slightly different acoustical tuning requirements.

The assignee of the subject invention also has developed certain hybrid mufflers that incorporate conventional tubular components into a stamp formed external shell. For example, U.S. Pat. No. 4,901,816 and U.S. Pat. No. 4,905,791 both show mufflers having stamp formed external shells that define a plurality of chambers. The exhaust pipe and tail pipe of an exhaust system extend well into the chambers defined by the formed external shells, and contribute to a selected flow pattern of exhaust gas through the muffler.

The prior art also includes mufflers with stamped internal components and a conventional wrapped tubular outer shell. For example, U.S. Pat. No. 4,396,090 issued to Wolfhugel on Aug. 2, 1983 and shows a muffler with a pair of internal plates that are stamped to define an array of tubes. The plates are supported in spaced relationship to the wrapped outer shell by a plurality of separately formed stamped baffles. The baffles extend outwardly from each plate to engage the tubular outer shell. Certain embodiments of the muffler shown in U.S. Pat. No. 4,396,090 show separate stamp formed chambers disposed within the tubular outer shell and connected to the plates that are formed to define the tubes of the muffler. The mufflers shown in U.S. Pat. No. 4,396,090 can avoid some of the problems associated with abrupt edges and corners within a conventional muffler, such as the conventional prior art muffler shown in FIG. 1 above. However, the complex combinations of plates, baffles and internal chambers required by U.S. Pat. No. 4,396,090 can result in complicated assembly problems and high costs.

The commercial successes achieved by the assignee of the subject invention in the field of stamp formed mufflers has been largely in connection with original equipment exhaust systems. The assignee has noticed muffler installers prefer to use a replacement muffler that substantially resembles the original equipment muffler being replaced. The assignee of the subject invention also has concluded that the production run size of each type of replacement muffler it manufactures invariably is smaller than the production run size of each type of original equipment muffler it manufactures. This occurs because each automobile manufacturer typically will deal with only one or two exhaust equipment suppliers for each line of automobiles being manufactured. Replacement mufflers, however, tend to be made by many more manufacturers. The smaller production runs of each model of replacement muffler make it difficult to amortize the costs of dies, even with the cost saving processees disclosed in the above referenced U.S. Pat. No. 4,847,965.

In view of the above, it is an object of the subject invention to provide replacement mufflers that incorporate many of the performance and manufacturing advantages attributable to stamp formed technology.

It is another object of the subject invention to provide replacement mufflers that more nearly duplicate the size and shape of the original equipment muffler being replaced.

A further object of the subject invention is to provide a system of replacement mufflers with substantially identical tubular outer shells, but structurally and functionally different stamp formed internal components.

SUMMARY OF THE INVENTION

The subject invention relates to an exhaust muffler, to a system comprising a plurality of exhaust mufflers and to a method of manufacturing mufflers. An exhaust muffler in accordance with the subject invention has at least one inlet for connection to an exhaust pipe on a vehicle and at least one outlet for connection to a tail pipe. Each muffler in accordance with this invention includes a tubular outer shell and opposed internal plates which are formed to define an array of channels. The internal plates are secured in face-to-face relationship such that the channels define an array of exhaust gas passages or tubes. The connected plates are dimensioned to be slidably received in the tubular outer shell. The internal plates are formed with unitary baffles to support the plates in the tubular outer shell and to form chambers between the tubular outer shell and the plates. At least one internal plate may further be formed to define at least one chamber between the internal plates. The chamber between the internal plates may be formed with arcuate walls to achieve efficient back pressure and effective attenuation of noise. Portions of the internal plates which define the chamber therebetween may be configured to engage the tubular outer shell, and thereby to support the internal plates within the tubular outer shell.

Mufflers in accordance with the subject invention may further include at least one conventional tube connected to and communicating with formed plates of the muffler. The conventional tube may extend through the formed chamber defined between the internal plates of the muffler. Upstream and downstream ends of the conventional tube may communicate with tubes defined by the stamped components of the muffler. Conventional tubes may also extend from the stamped components to external regions of the muffler to define inlet and outlet nipples for connection to an exhaust pipe and a tail pipe respectively.

The muffler further includes opposed end caps or heads securely connected to opposed ends of the muffler. The end caps or heads include apertures through which the inlet and outlet tubes of the muffler extend.

As noted above, the subject invention may be directed to a system that includes a plurality of mufflers. The tubular outer shells of certain mufflers in the plurality have different lengths than the tubular outer shells of other mufflers in the plurality. However, the cross-sectional sizes and shapes of the tubular outer shells of each of the mufflers in the plurality preferably are substantially identical. The stamped internal components of all of the mufflers in the plurality are substantially similar. More particularly, all of the stamp formed internal plates may have baffles and/or chambers defining identical cross-sections that correspond to the cross-sectional size and shape of the tubular outer shell. Thus, common or related sets of stamp formed internal plates may be slid into each of a plurality of external shells of selected lengths. The internal plates of the mufflers may be identical to one another at the completion of initial forming steps. However, certain formed internal plates in the plurality may be subjected to remanufacture steps, such as the incorporation of additional perforations, the opening of closed tubes or the like.

With this construction, replacement mufflers can be provided with external shapes and dimensions substantially corresponding to the original equipment muffler. The tubular outer shells can be manufactured fairly inexpensively with available automated machinery. Stamp formed internal plates of appropriate length and with a selected flow pattern then can be slid into the tubular outer shell. Baffles or chambers defined by the formed internal plates can be spot welded through the tubular outer shell to securely fix the formed internal plates at a selected longitudinal position therein. This relative position will determine the size of the chambers adjacent the ends of the muffler, and hence can be used to tailor the muffler to the acoustical needs of the vehicle for which the muffler is intended. Acoustical requirements of each muffler also can be accommodated by the above referenced remanufacture steps which affect the flow pattern for exhaust gas.

DETAILED DESCRIPTION OF THE PREFERRED EMBODIMENTS

Figure 2A:
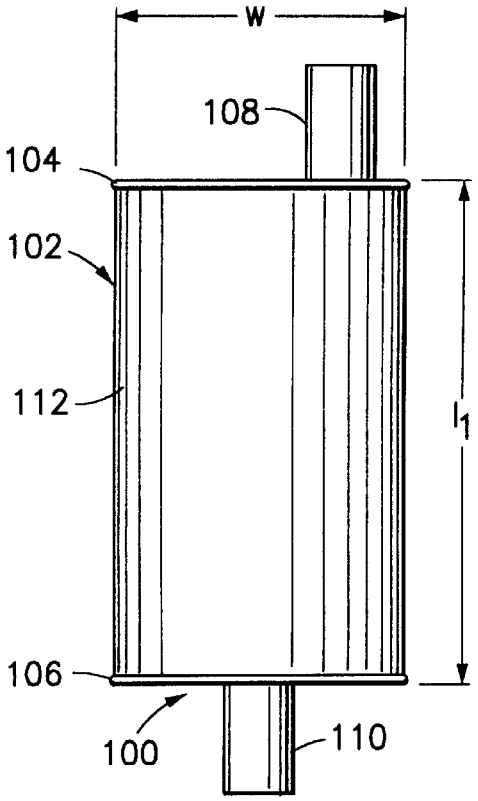
FIGS. 2A and 2B are top plan views of two mufflers in accordance with the subject invention.
Figure 2B:
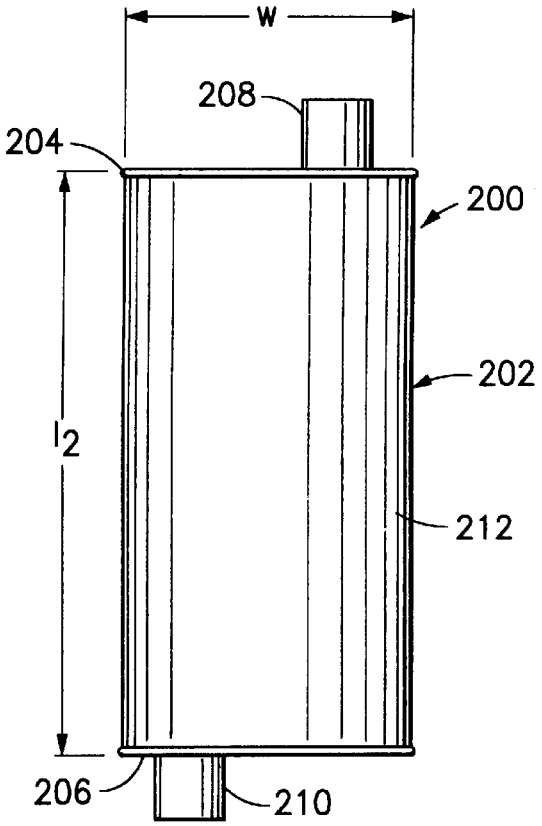
Figure 3A:
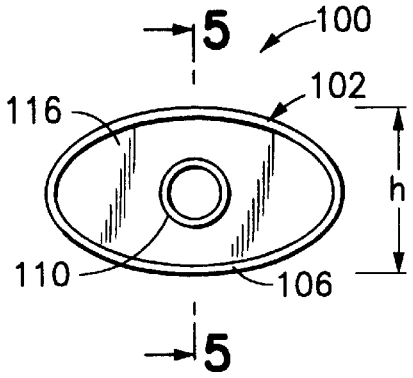
FIGS. 3A and 3B are end elevational views of the mufflers shown in FIGS. 2A and 2B.

A first muffler in accordance with the subject invention is identified generally by the numeral 100 in FIGS. 2A, 3A, 4A, 5 and 7. A second muffler in accordance with the subject invention is identified by the numeral 200 in FIGS. 2B, 3B and 4B. The muffler 100 includes an elongate generally tubular body 102 having opposed inlet and outlet ends 104 and 106 which define a length "$l_1$". An inlet nipple 108 extends into the inlet end 104 at an off center location as shown in FIG. 2A. An outlet nipple 110 extends from the outlet end 106 of the muffler body 102 at a central location, as shown most clearly in FIG. 3A. With further reference to FIGS. 2A and 3A, the muffler body 102 is of generally oval cross-sectional shape with a width "w" and a height "h".

Figure 3B:
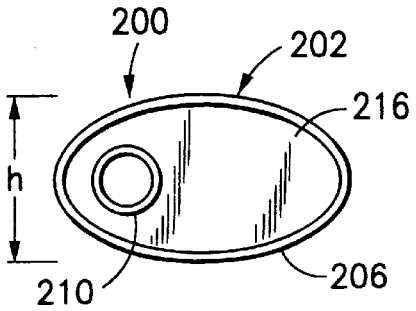

The muffler 200 includes a tubular muffler body 202 with opposed inlet and outlet ends 204 and 206 defining an overall length "$l_2$". As shown in FIGS. 2A and 2B, the length "$l_2$" of the muffler body 202 is greater than the length "$l_2$" of the muffler body 102. The muffler 200 includes an inlet nipple 208 extending into the inlet end 204 of the muffler body 202 at an off center location. An outlet nipple 210 extends from the outlet end 206 of the muffler body 202 at an off center location as shown most clearly in FIG. 3B. With further reference to FIGS. 2B and 3B, the muffler body 202 defines an oval cross-sectional shape substantially identical to that of the muffler 100, as indicated by the width and height dimensions "w" and "h". Thus, the mufflers 100 and 200 are of substantially identical cross-sectional shapes, but define different respective lengths "$l_1$" and "$l_2$", and have different outlet positions.

Figure 4A:
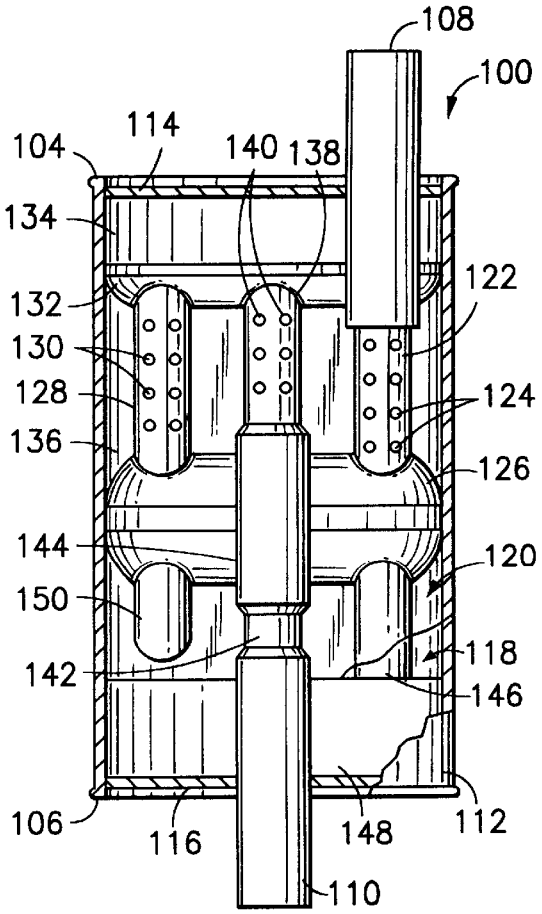
FIGS. 4A and 4B are top plan views, partly in section, of the respective muffler shown in FIGS. 2A and 2B.
Figure 5:
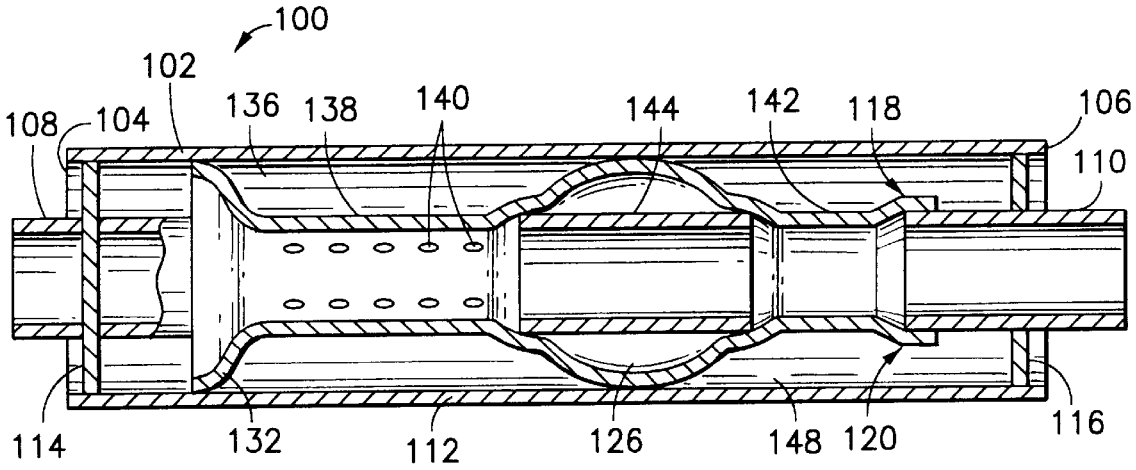
FIG. 5 is a cross-sectional view taken along lines 5—5 in FIG. 3A.
Figure 7:
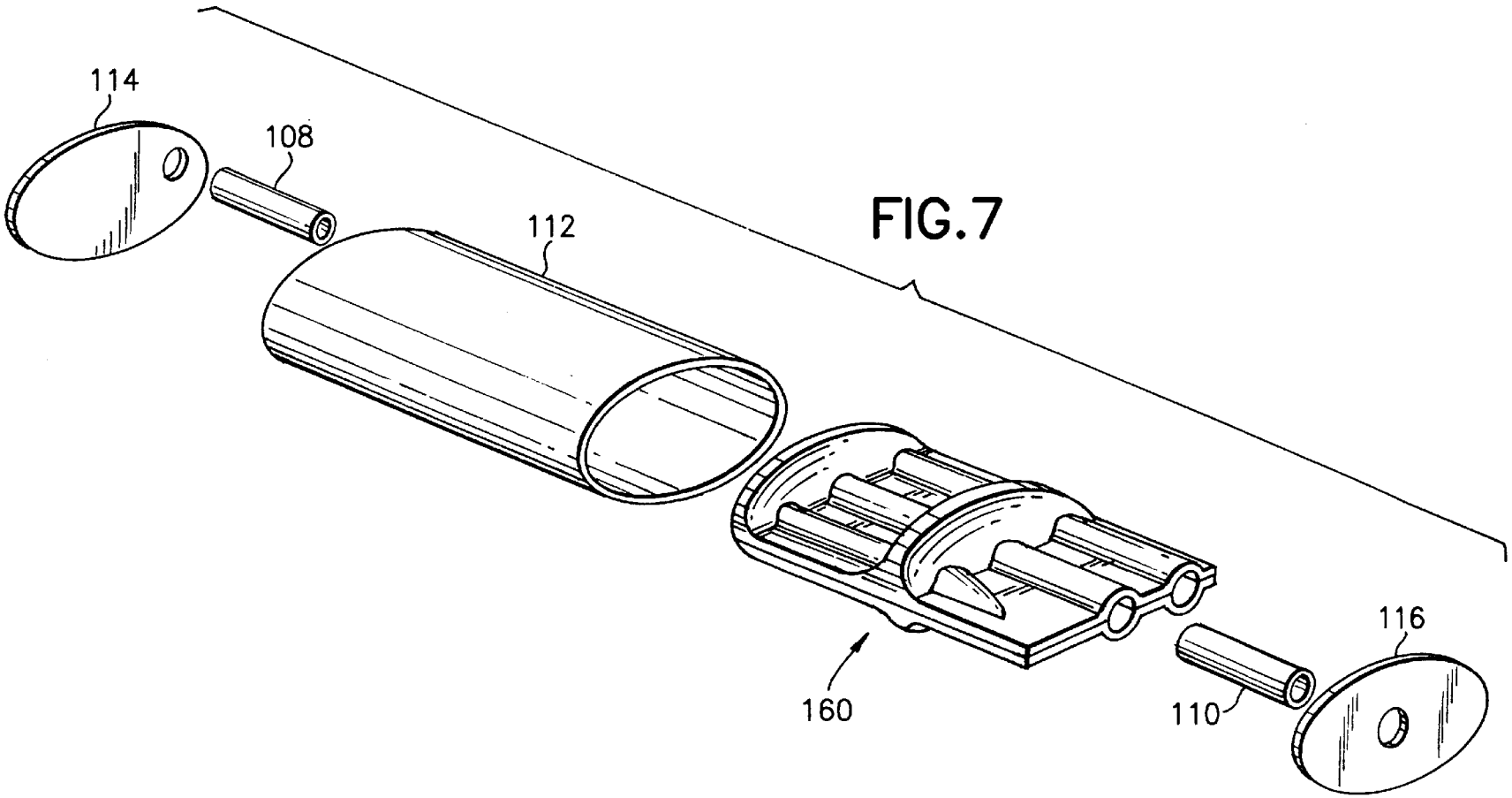
FIG. 7 is an exploded perspective view of the muffler shown in FIG. 4A.

The first muffler body 102 is defined by a generally tubular outer shell 112 and opposed inlet and outlet end caps or heads 114 and 116 through which the inlet nipples 108 and 110 extend. Exhaust gas is channeled from the inlet nipple 108 to the outlet nipple 110 through an array of tubes defined substantially by a pair of stamped formed plates 118 and 120, as shown in FIGS. 4A, 5 and 7. The internal plates 118 and 120 are stamped formed to define an array of channels and tubes. In this regard, plates 118 and 120 are formed to define a perforated inlet tube 122 that generally registers with the inlet nipple 108. Portions of the inlet tube 122 nearest the inlet end 104 of the muffler body 102 define a diameter sufficient to engage the outer circumferential surface of the inlet nipple 108. Remaining portions of the inlet tube 122 define a diameter approximately equal to the inside diameter of the inlet nipple 108. Additionally, these remaining portions of the inlet tube 122 are provided with perforations 124. As shown in FIG. 4A, the perforations 124 are generally circular apertures. However, other aperture shapes can be provided to permit a controlled expansion of exhaust gas. For example, slots, louvers or the like can be provided in place of the circular apertures 124.

The inlet tube 122 communicates with a first reversing chamber 126 defined entirely between the internal plates 118 and 120. Portions of the internal plates 118 and 120 defining the first reversing chamber 126 are dimensioned to engage the tubular outer shell 112 continuously about the oval or circular cross sectional shape. Preferably, welds or other such attachments secure the tubular outer shell 112 to the internal plates 118 and 120 at the first reversing chamber 126. A stamp formed first reversing tube 128 extends from the first reversing chamber 126 back toward the inlet end 104 of the muffler body 102. The stamp formed first reversing tube 128 is provided with perforations 130.

Portions of stamp formed internal plates 118 and 120 closest to the inlet end 104 of the muffler body 102 are formed outwardly to define a baffle 132 that engages the tubular outer shell 112. Portions of the baffle 132 preferably are welded or otherwise attached to the tubular outer shell 112. The stamp formed baffle 132 cooperates with the outer shell 112 and the inlet end cap or head 114 to define a second reversing chamber 134. Additionally, the baffle 132 cooperates with the outer shell 112 and the first reversing chamber 126 to define an expansion chamber 136 therebetween.

A second reversing tube 138 is formed by the internal plates 118 and 120 and extends from the baffle 132 back toward the first reversing chamber 126. The second reversing tube 138 also is provided with perforations 140 which permit expansion of exhaust gas into the expansion chamber 136.

An outlet tube 142 is formed by the internal plates 118 and 120 and extends from the first reversing chamber 126 to the end of the stamp formed plates 118 and 120 closest to the outlet end 106 of the muffler body 102. The outlet tube 142 is aligned with the second reversing tube 138. Additionally, portions of the second reversing tube 138 and the outlet tube 142 are enlarged and function as seats for a short conventional pipe 144 which extends across the first reversing chamber 126. Thus, exhaust gas flowing through the second reversing tube 138 will travel directly to the outlet tube 142 without communicating with the first reversing chamber 126. It will be appreciated that the conventional pipe 144 is disposed in the flow path of exhaust gas flowing through first reversing chamber 126 from the inlet tube 122 to the first reversing tube 128. Thus, exhaust gas must travel around both sides of the pipe 144, and will expand significantly prior to entering the first reversing tube 128. This expansion within the first reversing chamber 126 contributes to effective noise attenuation. The downstream end of the outlet tube 142 is dimensioned to receive the outlet nipple 110 which extends therefrom through the outlet head 116.

A tuning tube extends from the first reversing chamber 126 to the end of the internal plates 118 and 120 nearest the outlet end 106 of the muffler body 102. The tuning tube 146 communicates into a low frequency resonating chamber 148 defined between the first reversing chamber 126 and the outlet head 116. As discussed in the above referenced prior patents of the assignee, the length and cross-sectional dimensions of the tuning tube 146 and the volume of the low frequency resonating chamber 148 are selected to attenuate a narrow range of low frequency noise generated by the flowing exhaust gas. It will be appreciated that the volume of the low frequency resonating chamber 148 can be varied by fixing the internal plates 118 and 120 at a different longitudinal position within the outer shell 112.

The internal plates 118 and 120 are further formed to define a tube 150. In the embodiment depicted in FIG. 4A, the tube 150 is closed-ended, and contributes minimally to the acoustical tuning of the muffler 100. In other embodiments, however, the tube 150 may have other configurations as explained further herein.

The muffler 200 includes an outer shell 212 and opposed inlet and outlet headers 214 and 216. The muffler 200 also includes a pair of stamp formed internal plates 218 and 220 that are formed to include channels, chambers and baffles. The internal plates 218 and 220 are secured in face-to-face relationship substantially as described above, such that the channels define tubes that may communicate with certain of the chambers in the muffler 200.

Figure 4B:
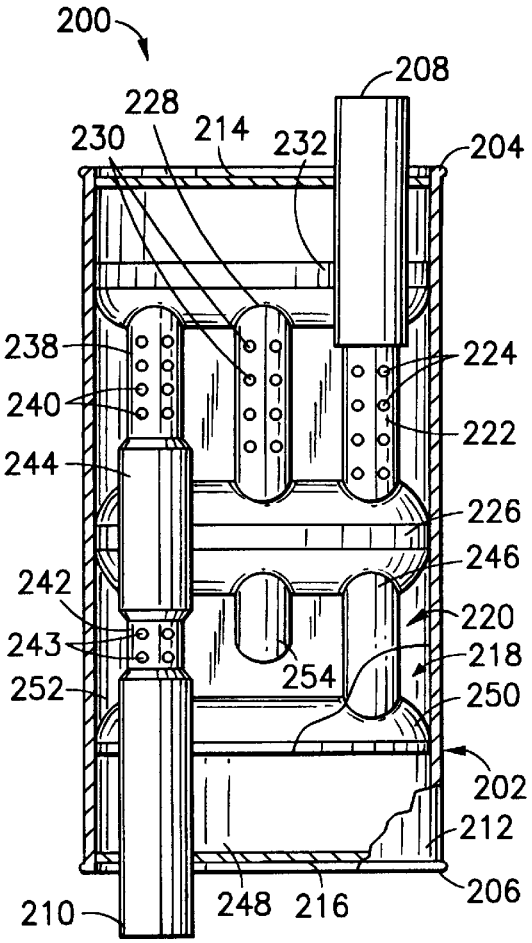

With reference to FIG. 4B, the internal plates 218 and 220 are formed to define an inlet tube 222 having perforations 224 therein. Portions of the inlet tube 222 nearest the inlet end 204 of the muffler body 200 are dimensioned to receive the inlet nipple 208. Remaining portions of the inlet tube 222 define a diameter approximately equal to the inside diameter of the inlet nipple 208. The inlet tube 222 extends to a first reversing chamber 226 defined entirely between the formed plates 218 and 220. Portions of the first reversing chamber 226 engage and are secured against the outer shell 212 by welding or other such attachment means. A first reversing tube 228 extends from the first reversing chamber back toward the inlet end 204 of the muffler body 200. It will be appreciated that the first reversing tube 228 is disposed at a central position in the muffler body 200, whereas the comparable first reversing tube 128 of the muffler body 102 was disposed at an off center position. The first reversing tube 228 of the muffler 200 is provided with perforations 230 to permit a controlled expansion of exhaust gas.

A first baffle 232 is formed at the end of the internal plates 218 and 220 nearest the inlet end 204 of the muffler body 202. The baffle 232 extends into contact with the tubular outer shell 212 and defines a second reversing chamber 234 near the inlet and 204 of the muffler body 202. Portions of the baffle 232 preferably are welded or otherwise attached to the tubular outer shell 212. The baffle 234 further cooperates with a first reversing chamber 226 and the outer shell 212 to define an expansion chamber therebetween. A second reversing tube 238 extends from the second reversing chamber 234 back toward the first reversing chamber 226. The second reversing tube 238 is provided with perforations 240 that permit a controlled expansion of exhaust gas into the expansion chamber 236. An outlet tube 242 extends from the first reversing chamber 226 toward the outlet end 206 of the muffler body 202. The outlet tube 242 is aligned with the second reversing tube 238. Perforations 243 are formed through the outlet tube for reasons explained further herein.

A conventional pipe 244 extends across the first reversing chamber 226 from the second reversing tube 238 to the outlet tube 242. The conventional pipe 244 is not perforated and is provided to ensure that the exhaust gas follows a conventional tri-flow pattern.

The internal plates 218 and 220 are further formed to define a tuning tube 246 which extends from the first reversing chamber 226 toward the outlet end 206 of the muffler body 202. The tuning tube communicates with a low frequency resonating chamber 248. Unlike the preceding embodiment, the internal plates 218 and 220 are formed to define a second baffle 250 which defines one limit of the low frequency resonating chamber 248. The second baffle further defines a high frequency tuning chamber 252 between the baffle 250 and the first reversing chamber 226. The perforations 243 in the outlet tube 242 enable communication of exhaust gas with the high frequency tuning chamber 252. The internal plates 218 and 220 are formed with a closed-ended tube 254 disposed centrally between the tuning tube 246 and the outlet tube 242.

Figure 6:
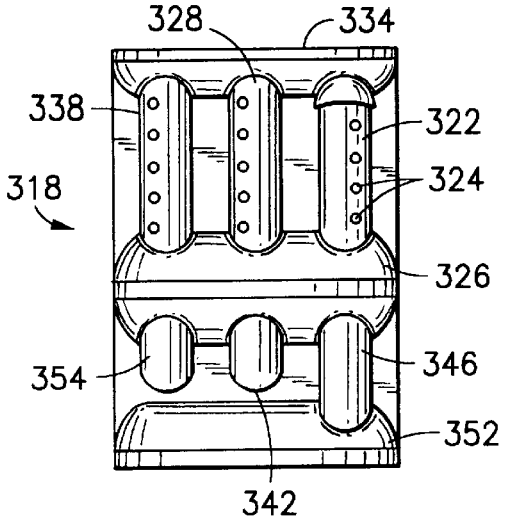
FIG. 6 is a top plan view of an inner plate prior to complete manufacturing.

The internal plates 118 and 120 and the internal plates 218 and 220 can be formed from pairs of generic plates that can be remanufactured and/or reformed slightly depending upon the particular end use. In this regard, FIG. 6 shows a generic stamp formed internal plate 318 having an inlet tube 322 with perforations 324 which leads to a first reversing chamber 326. Perforated tubes 328 and 338 extend between the first reversing chamber 326 and a first baffle 334. A tuning tube 346 extends from the first reversing chamber 326 to a second baffle 352. Closed end tubes 342 and 354 also extend from the first reversing chamber 326. The generic plate 318 depicted in FIG. 6 can be subject to remanufacture, such as restamping, to achieve a specified required flow pattern, such as the flow pattern achieved by the internal plates 118 or 120 or the flow pattern achieved by the internal plates 218 and 220. In this regard, the second baffle 352 on the generic internal plate 318 can merely be cut away from remaining portions of the internal plates to achieve the FIG. 4A construction with a very large low frequency resonating chamber. Additionally, either of the closed ended tubes 342 and 354 can be opened to function as an outlet tube or a second tuning tube communicating with a different low frequency resonating chamber. The generic internal plate 318 can be finished as part of a continuous manufacturing process, similar to that taught by the above referenced U.S. Pat. No. 4,847,965 relying upon various combinations of dies and die subsets. Alternatively, the generic internal plates 318 and 320 can be adapted for a particular application in a discontinuous manufacturing process, wherein a supply of generic internal plates 318 are stored for subsequent remanufacture by either stamping or other machining operations. It will be appreciated that the generic plate 318 shown herein is only an example. The generic internal plate 318 may be substantially closer to the final forms that may be employed in a finished muffler, or may be further removed from the final form. Additionally, many other flow patterns for exhaust gas may be provided beyond the standard tri-flow pattern depicted herein.

Figure 1:
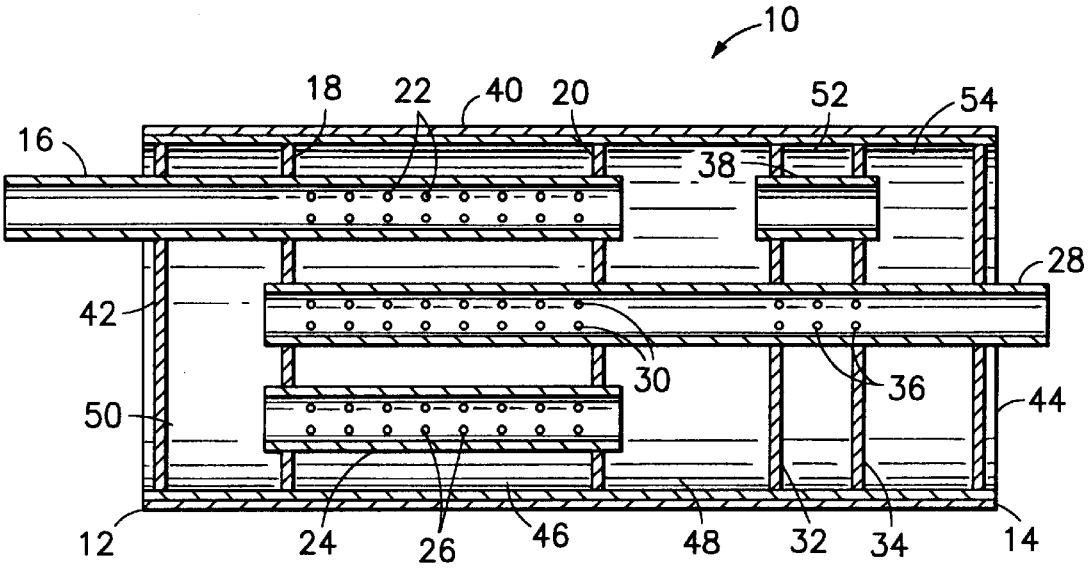
FIG. 1 PRIOR ART
FIG. 1 is a top plan view, partly in section, of a prior art muffler.

After the generic internal plate 318 has been completed as required, they are assembled together along with any conventional internal tubes 144, 244 that are specified. The connection of the stamp formed internal plates and the conventional tubular components preferably is carried out by welding. This completed subassembly for the embodiment depicted in FIGS. 2A, 3A and 4A is identified generally by the numeral 160 in FIG. 7. This subassembly is then slid axially into the external shell 112 of the required length. Portions of the baffles accessible from the open ends of the tubular outer shell 112, 212 are welded to the outer shell 112, 212. The opposed heads 114 and 116 or 214 and 216 are welded to the respective inlet and outlet nipples and then are attached to opposed longitudinal ends of the outer shell 112, 212 to complete the muffler as shown in FIGS. 2A, 3A, 4A and 5. It will be appreciated, with reference to FIGS. 2A and 3A, that the muffler 100 in all external respects resembles the conventional prior art muffler depicted in FIG. 1. However, the internal components are substantially different. These internal components are better suited to automated manufacturing processees. Furthermore, the ability to use a generic pair of formed internal plates that are capable of minor remanufacture enables substantial cost efficiencies to be achieved for even small runs of replacement mufflers. These minor remanufacturing steps and the relative longitudinal position of the subassembly 160 in the tubular outer shell 112 can substantially tailor the acoustical tuning to the needs of the particular muffler.

While the invention has been depicted with respect to a preferred embodiment, it is apparent that various changes can be made without departing from the scope of the invention as defined by the appended claims.

What is claimed is:

1. A method for manufacturing replacement mufflers for vehicles, said method comprising the steps:

forming a plurality of tubular outer shells, each of said tubular outer shells having substantially identical cross-sectional shapes and sizes, selected tubular outer shells in said plurality being longer than other of said shells;

forming a plurality of pairs of generic internal plates, each said generic internal plate being formed to include a plurality of channels and a plurality of support means, said internal plates in each said pair being dimensioned and configured to be connected in face-to-face relationship with one another such that said channels define an array of tubes between the plates in each said pair and such that said support means on any of said pairs of connected plates can engage an inner surface of any of said tubular outer shells;

subjecting the generic internal plates in at least one said pair to remanufacturing for achieving acoustical tuning needs of at least one selected replacement muffler;

securing said pairs of said generic internal plates in face-to-face relationship to define a plurality of subassemblies;

sliding each one of said plurality of subassemblies into a selected one of said tubular outer shells;

securing each one of said plurality of subassemblies at a selected longitudinal position within the selected one of said tubular outer shells; and providing pluralities of first and second heads dimensioned for attachment to ends of said tubular outer shells; each said head having an aperture therethrough;

securing pipes in the apertures of the respective first and second heads; and attaching the first and second heads and the pipes secured thereto to the respective ends of said tubular outer shell, such that said pipes communicate with the tubes formed by the internal plates.

2. The method of claim 1, wherein the remanufacturing step comprises perforating at least one of the channels in one of the generic internal plates.

3. The method of claim 1, wherein the remanufacturing step comprises removing at least a portion of one of the plurality of supports plates of one of the generic internal plates.

4. The method of claim 1, wherein the securing step comprises varying the longitudinal position of the subassembly within the tubular outer shell to coincide with a selected volume of a low frequency resonating chamber formed by the tubular outer shell, the generic internal plates and one of the first and second heads.

5. The method of claim 2, wherein the remanufacturing step comprises removing at least a portion of one of the plurality of supports plates of one of the generic internal plates.

* * * * *